US009085873B2

(12) United States Patent
Gabibulayev

(10) Patent No.: US 9,085,873 B2
(45) Date of Patent: Jul. 21, 2015

(54) HYDRAULIC SYSTEM FOR CONTROLLING A WORK IMPLEMENT

(75) Inventor: Magomed O. Gabibulayev, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 817 days.

(21) Appl. No.: 13/336,039

(22) Filed: Dec. 23, 2011

(65) Prior Publication Data

US 2013/0160879 A1 Jun. 27, 2013

(51) Int. Cl.

| | |
|---|---|
| ***F15B 11/08*** | (2006.01) |
| ***F15B 13/04*** | (2006.01) |
| ***E02F 9/22*** | (2006.01) |
| ***F15B 11/028*** | (2006.01) |

(52) U.S. Cl.

CPC ..... *E02F 9/2225* (2013.01); *E02F 9/2285* (2013.01); *F15B 11/028* (2013.01); *F15B 2211/3052* (2013.01); *F15B 2211/31558* (2013.01); *F15B 2211/411* (2013.01); *F15B 2211/41581* (2013.01); *F15B 2211/428* (2013.01); *F15B 2211/50563* (2013.01); *F15B 2211/511* (2013.01); *F15B 2211/5159* (2013.01); *F15B 2211/528* (2013.01); *F15B 2211/5756* (2013.01); *F15B 2211/6346* (2013.01); *F15B 2211/7053* (2013.01)

(58) Field of Classification Search

USPC ..... 91/450, 451, 452, 468

See application file for complete search history.

(56) References Cited

U.S. PATENT DOCUMENTS

| | | | | |
|---|---|---|---|---|
| 3,472,127 | A | 10/1969 | Scheidt et al. | |
| 3,960,059 | A * | 6/1976 | Schexnayder | 91/443 |
| 7,827,787 | B2 | 11/2010 | Cherney et al. | |
| 2004/0221714 | A1 | 11/2004 | Bitter et al. | |
| 2007/0044650 | A1 | 3/2007 | Kuehn et al. | |
| 2007/0074509 | A1 | 4/2007 | Zhang et al. | |
| 2008/0104953 | A1 * | 5/2008 | Vigholm | 60/413 |
| 2009/0000290 | A1 | 1/2009 | Brinkman | |
| 2010/0024410 | A1 | 2/2010 | Brickner | |
| 2011/0120297 | A1 | 5/2011 | Bitter et al. | |
| 2013/0129460 | A1 * | 5/2013 | Gabibulayev | 414/699 |

FOREIGN PATENT DOCUMENTS

| | | | |
|---|---|---|---|
| EP | 1300519 | B1 | 12/2010 |
| EP | 2365226 | A1 | 9/2011 |

* cited by examiner

*Primary Examiner* — Edward Look
*Assistant Examiner* — Daniel Collins
(74) *Attorney, Agent, or Firm* — Finnegan, Henderson, Farabow, Garrett & Dunner, LLP

(57) ABSTRACT

A hydraulic system includes a first hydraulic circuit and a second hydraulic circuit. The first hydraulic circuit includes a hydraulic cylinder assembly, a pressurized fluid source, a fluid tank, and a metering control valve. The hydraulic cylinder assembly includes a cylinder, a rod, a head end including a head pressure, and a rod end including a rod pressure. The metering control valve includes a rod extension position, and a rod retraction position, and is fluidly connected to the head end, the rod end, the fluid source, and the fluid tank. The second hydraulic circuit includes a second circuit valve assembly selectively fluidly connected to the head end, the rod end, and the fluid tank.

19 Claims, 7 Drawing Sheets

HYDRAULIC SYSTEM FOR CONTROLLING A WORK IMPLEMENT

TECHNICAL FIELD

The present disclosure relates generally to a hydraulic system for controlling a work implement. Specifically, the disclosure relates to a hydraulic system including a first hydraulic circuit with a hydraulic cylinder assembly and a secondary hydraulic circuit selectively connecting the hydraulic cylinder assembly to a fluid tank.

BACKGROUND

Machines with work implement systems actuated with hydraulic circuits and hydraulic cylinder assemblies may size hydraulic control valves to allow operators more control when work implements are subject to over-running loads. Smaller cross sectional sizing of control valves may also allow fine control of work implement movements during operation. Although smaller cross sectional areas of control valves may allow better control during certain work conditions, they may be less power efficient and slower to respond in comparison to larger cross sectional areas of control valves, when work implements encounter resistive loads.

United States Patent Application Publication US 201010024410 A1, filed by Brickner, discloses a hydraulic system for a machine. The hydraulic system includes an actuator with a first chamber and a second chamber, a first valve, a second valve, a third valve, and an operator input device displaceable from a neutral position to generate a signal indicative of a desired movement of the actuator. The hydraulic system further includes a controller configured to open the first and third valves by amounts related to a signal to pass fluid, and open the second valve by an amount related to the signal to pass fluid when the signal indicates a desire for increased actuator velocity. The third valve may continue to open during opening of the second valve.

SUMMARY OF THE INVENTION

In one aspect the disclosure includes a hydraulic system including a first hydraulic circuit and a second hydraulic circuit. The first hydraulic circuit includes a hydraulic cylinder assembly, a pressurized fluid source, a fluid tank, and a metering control valve. The hydraulic cylinder assembly includes a cylinder, a rod, a head end including a head pressure, and a rod end including a rod pressure. The metering control valve includes a rod extension position, and a rod retraction position, and is fluidly connected to the head end, the rod end, the fluid source, and the fluid tank. The second hydraulic circuit includes a second circuit valve assembly selectively fluidly connected to the head end, the rod end, and the fluid tank. The second circuit valve assembly is operable to fluidly connect the rod end to the fluid tank when the head pressure exceeds the rod pressure by a first predetermined value. The second circuit valve assembly is also operable to fluidly connect the head end to the fluid tank when the rod pressure exceeds the head pressure by a second predetermined value.

In another aspect, the disclosure includes a machine including a power source, a work implement, and a hydraulic system. The hydraulic system includes a first hydraulic circuit and a second hydraulic circuit. The first hydraulic circuit includes a hydraulic cylinder assembly, a pressurized fluid source powered by the power source, a fluid tank, and a metering control valve. The hydraulic cylinder assembly includes a head end including a head pressure, a rod end including a rod pressure, a cylinder, and a rod operably connected to the work implement. The metering control valve includes a rod extension position, and a rod retraction position, and is fluidly connected to the head end, the rod end, the fluid source, and the fluid tank. The second hydraulic circuit includes a second circuit valve assembly selectively fluidly connected to the head end, the rod end, and the fluid tank. The second circuit valve assembly is operable to fluidly connect the rod end to the fluid tank when the head pressure exceeds the rod pressure by a first predetermined value. The second circuit valve assembly is also operable to fluidly connect the head end to the fluid tank when the rod pressure exceeds the head pressure by a second predetermined value.

DETAILED DESCRIPTION

Reference will now be made in detail to specific embodiments or features, examples of which are illustrated in the accompanying drawings. Generally, corresponding or similar reference numbers will be used, when possible, throughout the drawings to refer to the same or corresponding parts.

Figure 1:
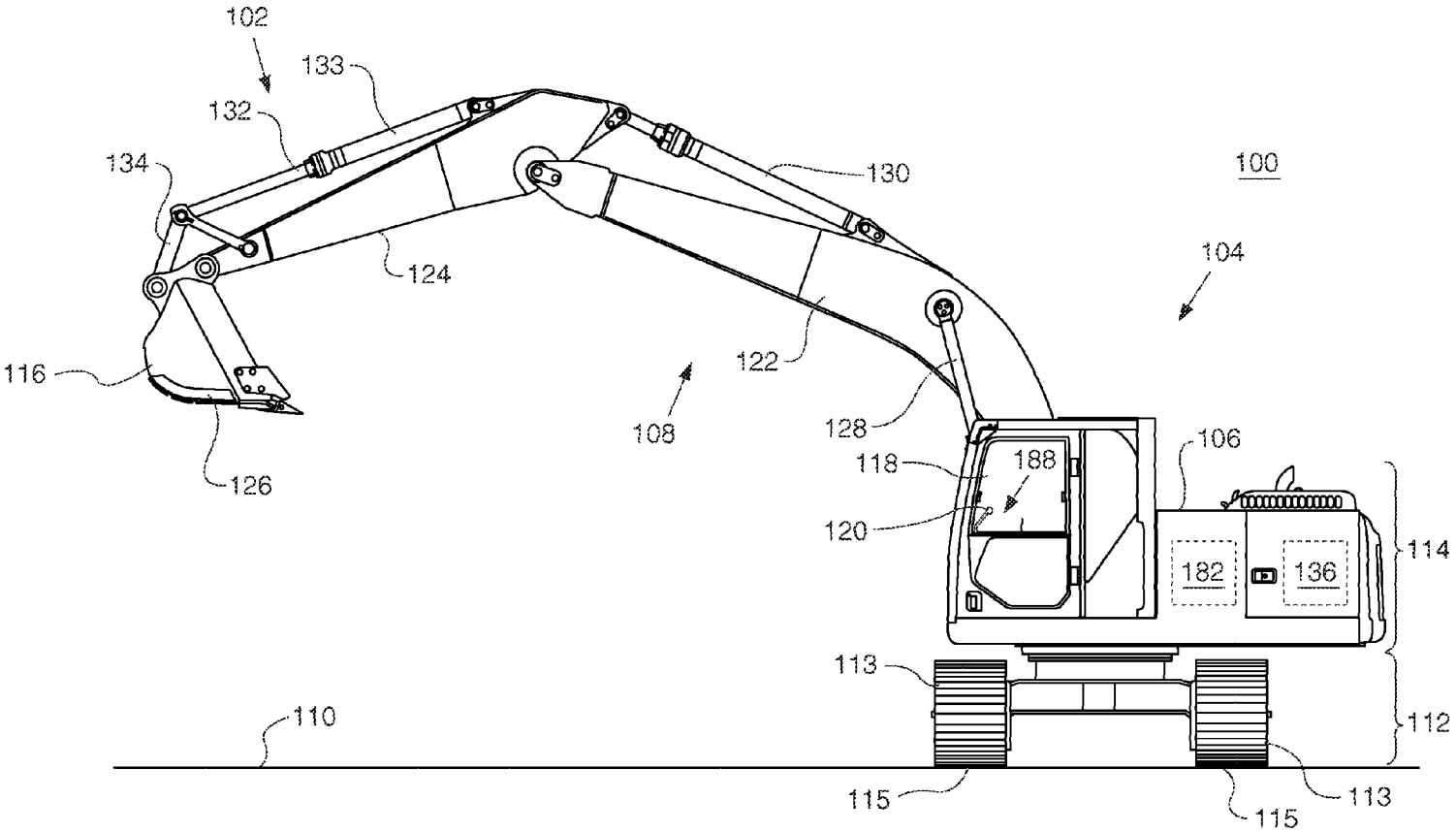
FIG. 1 illustrates an exemplary embodiment of a machine.

Referring now to FIG. 1, an exemplary embodiment of machine 100 is illustrated. In the embodiment illustrated, the machine 100 is depicted as a vehicle 104, and in particular an excavator 106. In other embodiments, the machine 100 may include any system or device for doing work with a hydraulically powered work implement control system 108 which would be known to an ordinary person skilled in the art now or in the future.

The vehicle 104 may include but is not limited to vehicles that perform some type of operation associated with a particular industry such as mining, construction, farming, transportation, etc. and operate between or within work environments (e.g. construction site, mine site, power plants, on-highway applications, marine applications, etc.). Non-limiting examples of vehicle 104 include cranes, earthmoving vehicles, mining vehicles, backhoes, loaders, material handling equipment, and farming equipment.

Machine 100 is equipped with systems that facilitate the operation of the machine 100 at worksite 110. In the depicted embodiment, these systems include the work implement control system 108, a drive system 112, and a power system 114 that provides power to the work implement control system 108 and the drive system 112. In the depicted embodiment, the power system 114 includes an engine 136, for example an internal combustion engine. In alternative embodiments the power system 114 may include other power sources such as electric motors (not shown), fuel cells, (not shown), batteries (not shown), ultra-capacitors (not shown), electric generators (not shown), and/or any power source which would be known by an ordinary person skilled in the art now or in the future.

The drive system 112 may include a transmission (not shown), and ground engaging devices 115. The transmission may include any device or group of devices that may transfer force between the power system 114 and the ground engaging devices 115. The transmission may include one or more of a mechanical transmission, variator, gearing, belts, pulleys, discs, chains, pumps, motors, clutches, brakes, torque converters, fluid couplings and any transmission which would be known by an ordinary person skilled in the art now or in the future.

The work implement control system 108 includes a work implement 116, which may perform work at worksite 110. In the depicted embodiment, the work implement 116 is a bucket 126. In alternative embodiments the work implement may include other types of work implements 116 such as (but not limited to) blades, lift groups, material handling arms, multi-processors, rakes, shears, snow plows and snow wings.

The work implement control system 108 may include any members, and linkages; as well as any systems and controls to actuate the members and linkages as a function of operator, autonomous system, or other inputs, to maneuver the work implement 116 to perform work at worksite 110, which would be known by an ordinary person skilled in the art now or in the future.

In the depicted embodiment of a excavator 106, the work implement control system 108 includes a boom 122, a stick 124, the bucket 126, at least one boom cylinder assembly 128, a stick cylinder assembly 130, a work implement cylinder assembly 102, a work implement linkage 134, a controller 182, and an operator interface 188. The work implement cylinder assembly 102 includes a work implement cylinder 133, and a work implement rod 132.

In the depicted embodiment, machine 100 includes a cab 118 including the operator interface 188. The operator interface 188 may include devices with which an operator communicates with, interacts with, or controls the machine 100. In one embodiment, the operator interface 188 may include devices with which the operator interacts physically. In another embodiment, the devices may operate with voice activation. In still other embodiments, the operator may interact with the operator interface 188 in any way a person skilled in the art would contemplate now or in the future. In the depicted embodiment, the operator interface includes a joystick 120.

The operator interface 188 may be operable to generate commands to the work implement control system 108 to move the work implement 116 to perform work at the worksite 110. The operator interface 188 may be operable to generate work implement control system 108 control commands as a function of predetermined movement from an operator. In alternative embodiments, machine controls encoded in the controller 182 onboard the machine 100, or an autonomous control system located remotely from the machine 100 may communicate work implement control system 108 commands.

In the depicted embodiment, an operator may enter commands to maneuver the work implement 116 through moving the joystick 120. These commands may be transmitted via sensors and communication links to the controller 182. The controller 182 may transmit signals via communication links to actuate hydraulic fluid valves to allow pressurized fluid flow to and from the cylinder assemblies 128, 130, 102 as is well known in the art. As pressurized fluid flows to and from the cylinder assemblies 128, 130, 102, rods (such as work implement rod 132) may extend from and retract into cylinders (such as work implement cylinder 133) to move the work implement 116. In other embodiments hydro-mechanical control systems may transmit operator commands to actuate the work implement 116.

In the depicted embodiment, a work implement linkage assembly 134 is operably connected to the work implement rod 132 and the work implement 116 to actuate work implement 116 in a desired way.

The controller 182 may include a processor (not shown) and a memory component (not shown). The processor may include microprocessors or other processors as known in the art. In some embodiments the processor may include multiple processors. The processor may execute instructions transmitted through the operator interface 188 or other means such as remote or autonomous controls to perform work at the worksite 110 with work implement 116. The memory component may include any form of computer-readable media which would be known to an ordinary person skilled in the art now or in the future. The memory component may include multiple memory components.

The controller 182 may be enclosed in a single housing. In alternative embodiments, the controller 182 may include a plurality of components operably connected and enclosed in a plurality of housings. The controller 182 may be located on-board the machine, or may be located off-board or remotely.

The controller 182 may be communicatively connected to the operator interface 188 to receive operator command signals, and operatively connected to hydraulic valves to control movement of the work implement 116. The controller 182 may be communicatively connected to one or more sensors or other devices to receive signals indicative of machine 100 system operating parameters.

An operator, or an autonomous function, may desire to dig earth or other material at work site 110 with the depicted excavator 106, and then dump the material into a haul truck (not shown) or other holding vehicle. As the work implement control system 108 responds to dig commands, the rod 132 may extend from the cylinder 133, and the bucket 126 may begin to close, moving downwards and curling inward towards the stick 124 and cab 118, digging material and then holding it as is well known by ordinary persons skilled in the art. While the bucket 126 is digging, a resistive load may be applied to the work implement cylinder assembly 102 as the material the bucket 126 is digging resists the extension of the rod 132. Once the material is dug and contained in the bucket 126, gravitational force on the material may apply an overrunning load on work implement cylinder assembly 102. Resistive and overrunning loads on cylinder assemblies are well known by ordinary persons skilled in the art.

The operator, or an autonomous function, may position the loaded bucket 126 containing the material over the haul truck, and then begin a dump function. During the dump function the rod 132 may be retracted into the cylinder 133 causing the bucket 126 to open, rotating outwards from the stick 124 and cab 118, and dump the material into the haul truck as is well known by ordinary persons skilled in the art. During the dump cycle gravitational forces on the material in the bucket 126 may apply both resistive and overrunning loads on work implement cylinder assembly 102.

When gravitational force on the material in the bucket 126, the force needed to dig material with bucket 126, or other forces apply a resistive load on work implement cylinder assembly 102, a fluid conduit for fluid to return to tank from the work implement cylinder assembly 102 with a restrictively small cross sectional area may cause unnecessary energy losses, and decrease productivity through slowing work implement 116 response. A fluid conduit for fluid to return to tank from the work implement cylinder assembly 102 with too large a cross sectional area may cause the operator difficulty when fine movements of the work implement 116 are needed, may make load holding difficult, and/or may make control of the work implement 116 during overrunning loads difficult.

Figure 2:
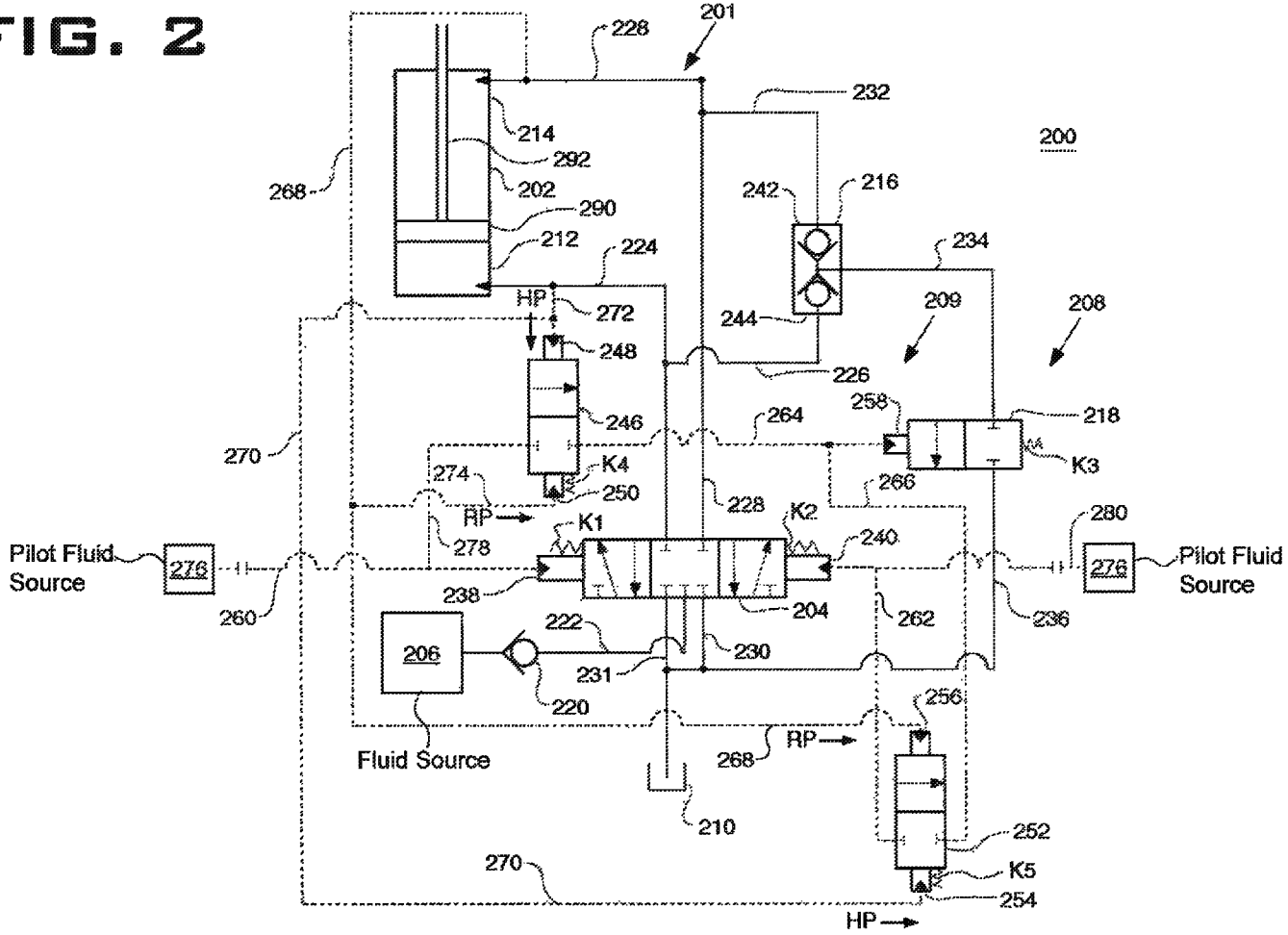
FIG. 2 illustrates an exemplary first embodiment of a hydraulic system with a metering control valve in a closed position.
Figure 3:
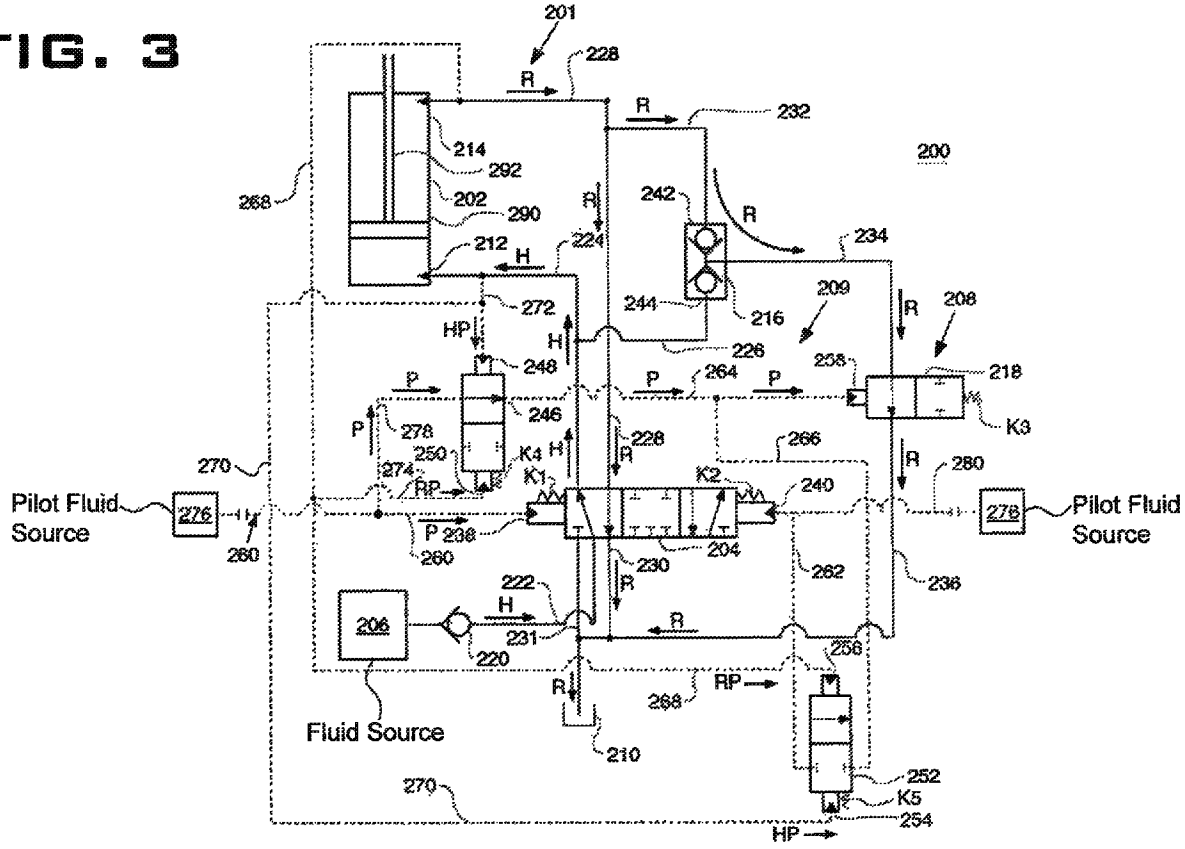
FIG. 3 illustrates the exemplary first embodiment of the hydraulic system with the metering control valve in a rod extension position.
Figure 4:
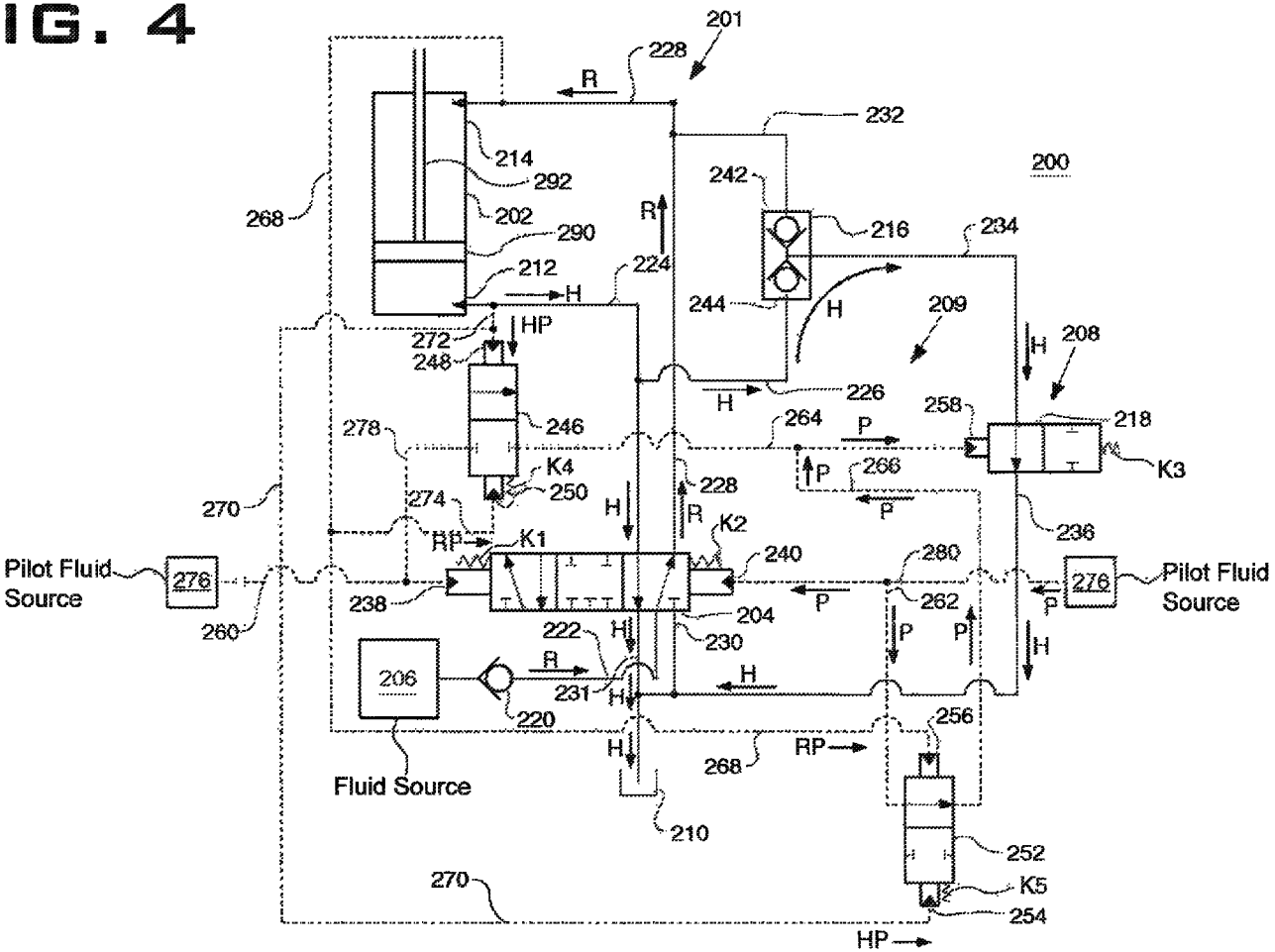
FIG. 4 illustrates the exemplary first embodiment of the hydraulic system with the metering control valve in a rod retraction position.

Referring now to FIGS. 2, 3, and 4, a first embodiment of a hydraulic system 200 is depicted. The system 200 includes a first hydraulic circuit 201 and a second hydraulic circuit 208. The first hydraulic circuit 201 includes a metering control valve 204 and a hydraulic cylinder assembly 202 with a head end 212 having a head pressure and a rod end 214 having a rod pressure. Metering control valve 204 includes a closed position, a rod extension position, and a rod retraction position. FIG. 2 depicts system 200 with metering control valve 204 in the closed position. FIG. 3 depicts system 200 with metering control valve 204 in the rod extension position and illustrates fluid flow when the head pressure exceeds the rod pressure by a first predetermined value. FIG. 4 depicts system 200 with metering control valve 204 in the rod retraction position and illustrates fluid flow when the rod pressure exceeds the head pressure by a second predetermined value.

The hydraulic system 200 is suitable for use in the excavator 106 of FIG. 1. The hydraulic cylinder assembly 202 may, for example, correspond to the work implement cylinder assembly 102. The hydraulic system 200 may also be suitable for use actuating other linkages illustrated in FIG. 1, or for actuating other tools on other machines 100.

The first hydraulic circuit 201 includes a hydraulic cylinder assembly 202, a pressurized fluid source 206, a fluid tank 210, and a metering control valve 204. The cylinder assembly 202 includes a head end 212 having a head pressure, a rod end 214 having a rod pressure, a cylinder 290, and a rod 292. The metering control valve 204 includes a rod extension position (shown in relation to FIG. 3) and a rod retraction position (shown in relation to FIG. 4). The metering control valve 204 is fluidly connected to the head end 212, the rod end 214, the fluid source 206, and the fluid tank 210.

The cylinder assembly 202 may include any mechanical actuator operable to apply a substantially unidirectional force through a unidirectional stroke which would be known to an ordinary person skilled in the art now or in the future. The rod 292 may include a piston which divides the cylinder 290 into two (2) chambers, one on the head end 212, and one on the rod end 214. Each chamber may include a port through which fluid may flow in and out of the chamber. The rod 292 may move back and forth in the cylinder 290 as fluid flows in and out of the chambers, as is known by ordinary persons skilled in the art. The rod 292 may be operably connected to the work implement 116.

In the excavator 106 embodiment depicted in FIG. 1, the rod 292 may correspond to work implement rod 132 and be operably connected to the work implement linkage assembly 134, to open and close the bucket 126. Pressurized fluid may flow into the head end 212, extending the rod 292 from the cylinder 290, and closing the bucket 126. As pressurized fluid flows into the head end 212, fluid flows out of the rod end 214. Pressurized fluid may also flow into the rod end 214, retracting the rod 292 into the cylinder 290, and opening the bucket 126. As pressurized fluid flows into the rod end 214, fluid flows out of the head end 212.

The fluid source 206 may include any source of pressurized hydraulic fluid which would be known by an ordinary person skilled in the art now or in the future. The fluid source 206 may include, but is not limited to, a fixed displacement pump (not shown), a variable displacement pump (not shown), a hydraulic fluid accumulator (not shown), or any other pressurized fluid energy storage device. In the depicted embodiment, engine 136 may drive fluid source 206 through one or more gears. In alternative embodiments, the fluid source 206 may include a pump driven in any manner which would be known by an ordinary person skilled in the art now or in the future. Non-limiting examples include gear driven, belt driven, or electric motor driven pumps.

The fluid tank 210 may include any reservoir for holding fluid which would be known by an ordinary person skilled in the art now or in the future.

Springs hold the metering control valve 204, as shown in FIG. 2, in a position substantially inhibiting flow through the metering control valve 204. One of the springs may have a spring constant of K1, and another spring may have a spring constant of K2. The metering control valve 204 may be hydraulically actuated.

The metering control valve 204 may include a rod extension pilot port 238 selectively fluidly connected to a pilot pressurized fluid source 276 through pilot fluid conduit 260. When fluid from the pilot fluid source 276, with a high enough pressure to overcome the force of the K2 spring, flows through pilot fluid conduit 260 to the rod extension pilot port 238, the metering control valve 204 may move to the rod extension position as shown in FIG. 3. The rod extension pilot port 238 may be selectively fluidly connected to the pilot fluid source 276 through a valve (not shown) actuated by a signal from the controller 182, or by other electrical, mechanical, pneumatic, or hydraulic means which would be known by an ordinary person skilled in the art now or in the future. For example, a solenoid actuated directional valve may be used, which may be actuated by a current signal from the controller 182. The controller 182 may generate this signal as a function of an operator input through operator interface 188, or may generate this signal as a function of an input from a remote or automated control system.

The metering control valve 204 may include a rod retraction pilot port 240 selectively fluidly connected to a pilot pressurized fluid source 276 through pilot fluid conduit 280. When fluid from the pilot fluid source 276, with a high enough pressure to overcome the force of the K1 spring, flows through pilot fluid conduit 280 to the rod retraction pilot port 240, the metering control valve 204 may move to the rod retraction position as shown in FIG. 4. The rod retraction pilot port 240 may be selectively fluidly connected to the pilot fluid source 276 in a similar way as the rod extension pilot port 238.

The pilot fluid source 276 may include the fluid source 206 or the pilot fluid source 276 may be a separate source. The pilot fluid source 276 may, for example, include a pump driven by the engine 136 through gears. In other embodiments the pilot fluid source may include a fixed displacement pump (not shown), a variable displacement pump (not shown), a hydraulic accumulator, or any other pressurized fluid source which would be known by an ordinary person skilled in the art now or in the future. The pilot fluid source 276 may be driven or powered by the power system 114 through mechanical linkage, electrically, hydraulically, or by any means which would be known by an ordinary person skilled in the art now or in the future.

In the depicted embodiment, the head end 212 is fluidly connected to the metering control valve 204 via fluid conduit 224. The rod end 214 is fluidly connected to the metering control valve 204 through fluid conduit 228. The fluid source 206 is fluidly connected to the metering control valve 204 through a check valve 220 and fluid conduit 222. The tank 210 is fluidly connected to the metering control valve 204 through fluid conduits 230 and 231.

As shown in relation to FIG. 3, when the metering control valve 204 is in the rod extension position, pressurized fluid may flow in the first hydraulic circuit 201, from the fluid source 206 through the check valve 220, through fluid conduit 222, through the metering control valve 204, and through fluid conduit 224 to the head end 212. When the metering control valve 204 is in the rod extension position, fluid may flow in the first hydraulic circuit 201, from the rod end 214, through fluid conduit 228, through the metering control valve 204, through fluid conduit 230, and to the tank 210.

As shown in relation to FIG. 4, when the metering control valve 204 is in the rod retraction position, pressurized fluid may flow in the first hydraulic circuit 201, from the fluid source 206 through the check valve 220, through fluid conduit 222, through the metering control valve 204, and through fluid conduit 228 to the rod end 214. When the metering control valve 204 is in the rod retraction position, fluid may flow in the first hydraulic circuit 201, from the head end 212, through conduit 224, through the metering control valve 204, through fluid conduit 231, and to the tank 210.

The second hydraulic circuit 208 includes a second circuit valve assembly 209 selectively fluidly connected to the head end 212, the rod end 214, and the fluid tank 210. The second circuit valve assembly 209 is operable to fluidly connect the rod end 214 to the fluid tank when the head pressure exceeds the rod pressure by a first predetermined value. The second circuit valve assembly 209 is also operable to fluidly connect the head end 212 to the fluid tank 210 when the rod pressure exceeds the head pressure by a second predetermined value.

As shown in relation to FIGS. 2-4, the second circuit valve assembly 209 may include an inverse shuttle valve 216, a first directional control valve 218, a third directional control valve 246, and a fourth directional control valve 252.

The first directional control valve 218 may include a two position, spring biased, normally closed, and hydraulically actuated directional valve. Although the first directional control valve 218 is shown as a hydraulically actuated valve, it is contemplated that the first directional control valve 218 may be actuated by other means, such as, but not limited to, electrical current or pneumatics. In alternative embodiments the first directional control valve 218 may include any device for controlling the flow of fluid in the second hydraulic circuit from either the head end 212 or the rod end 214 to the tank 210.

The first directional control valve 218 may include a pilot port 258, and a biasing spring with a spring constant of K3. When fluid with a pressure great enough to overcome the K3 spring force is applied to the pilot port 258, first directional control valve 218 opens, allowing fluid to flow from fluid conduit 234, through the first directional control valve 218, through fluid conduit 236, and to the tank 210. The pilot port 258 may be selectively fluidly connected to the pilot fluid source 276, such that when the head pressure exceeds the rod pressure by a first predetermined value, or the rod pressure exceeds the head pressure by a second predetermined value, pilot fluid flows from pilot fluid source 276 to pilot port 258.

The first directional control valve 218 may include an input port and an output port. The input port of the first directional control valve 218 may be fluidly connected to the output port of the inverse shuttle valve 216 through fluid conduit 234. The output port of the first directional control valve 218 may be fluidly connected to the tank 210 through fluid conduit 236.

The inverse shuttle valve 216 may include any valve that regulates the supply of fluid from more than one source into a single area of the circuit, by allowing the lower pressure source to flow through the valve. The inverse shuttle valve 216 may include an rod input port 242 fluidly connected to the rod end 214 through fluid conduit 232, an head input port 244 fluidly connected to the head end 214 through fluid conduit 226, and an output port selectively fluidly connected to the tank 210 through fluid conduits 234, 236 and the first directional control valve 218.

As shown in relation to FIG. 4, when the rod pressure is greater than the head pressure, the inverse shuttle valve 216 allows fluid from the head end 212 to flow through the head port 244 from fluid conduit 226, and out through the output port to fluid conduit 234. As shown in relation to FIG. 3, when the head pressure is greater than the rod pressure, the inverse shuttle valve 216 allows fluid from the rod end 214 to flow through the rod port 242 from fluid conduit 232, and out through the output port to fluid conduit 234.

The third directional control valve 246 may include a two position, spring biased, normally closed, and hydraulically actuated directional valve. Although the third directional control valve 246 is shown as a hydraulically actuated valve, it is contemplated that the third directional control valve 246 may be actuated by other means, such as, but not limited to, electrical current or pneumatics. In alternative embodiments the third directional control valve 246 may include any device for fluidly connecting the pilot fluid source 276 to the pilot port 258 of the first directional valve 218 when the head pressure exceeds the rod pressure by the first predetermined value, as shown in relation to FIG. 3.

The third directional control valve 246 may include an input port and an output port. The input port may be fluidly connected to the pilot fluid source 276 through pilot fluid conduit 278. In one embodiment, the input port may be connected to the rod extension pilot port 238 of the metering control valve 204, such that the input port is fluidly connected to the pilot fluid source 276 when the rod extension pilot port 238 is connected to the pilot fluid source 276. The output port of third directional control valve 246 may be fluidly connected to the pilot port 258 of the first directional control valve 218 through pilot fluid conduit 264.

The third directional control valve 246 may include a head pilot port 248, and a rod pilot port 250. The head pilot port 248 may be fluidly connected to the head end 212, through pilot fluid conduit 272, such that the head pressure is applied to head pilot port 248 as indicated by "HP" and an arrow. The rod pilot port 250 may be fluidly connected to the rod end 214, through pilot fluid conduit 274, such that the rod pressure is applied to rod pilot port 250 as indicated by "RP" and an arrow.

The third directional control valve 246 may include a biasing spring, with a spring constant of K4. When the head pressure, applied at the head pilot port 248, is great enough to overcome the combined force of the K4 spring and the rod pressure applied at the rod pilot port 250, the third directional control valve 246 opens. When the third directional valve 246 opens, pilot fluid flows from the pilot fluid source 276, through pilot fluid conduit 278, through third directional control valve 246, through pilot fluid conduit 264, and to the pilot port 258 of first directional control valve 218. The third directional control valve 246 biasing spring may be chosen such that the K4 spring preload force corresponds to the first predetermined value, and the third directional control valve 246 opens when the head pressure exceeds the rod pressure by the first predetermined value.

In the embodiment where the input port of the third directional control valve 246 is connected to the rod extension pilot port 238 of the metering control valve 204, the first directional valve 218 may open when the metering control valve 204 is in the rod extension position and the head pressure exceeds the rod pressure by a first predetermined value, as illustrated in FIG. 3.

The fourth directional control valve 252 may include a two position, spring biased, normally closed, and hydraulically actuated directional valve. Although the fourth directional control valve 252 is shown as a hydraulically actuated valve, it is contemplated that the fourth directional control valve 252 may be actuated by other means, such as, but not limited to, electrical current or pneumatics. In alternative embodiments the fourth directional control valve 252 may include any device for fluidly connecting the pilot fluid source 276 to the pilot port 258 of the first directional valve 218 when the rod pressure exceeds the head pressure by the second predetermined value as shown in relation to FIG. 4.

The fourth directional control valve 252 may include an input port and an output port. The input port may be fluidly connected to the pilot fluid source 276 through pilot fluid conduit 262. The output port of fourth directional control valve 252 may be fluidly connected to the pilot port 258 of the first directional control valve 218 through pilot fluid conduit 266.

The fourth directional control valve 252 may include a rod pilot port 256, and a head pilot port 254. The rod pilot port 256 may be fluidly connected to the rod end 214, through pilot fluid conduit 268, such that the rod pressure is applied to rod pilot port 256 as indicated by "RP" and an arrow. The head pilot port 254 may be fluidly connected to the head end 212, through pilot fluid conduit 270, such that the head pressure is applied to head pilot port 254 as indicated by "HP" and an arrow.

The fourth directional control valve 252 may include a biasing spring, with a spring constant of K5. When the rod pressure applied at the rod pilot port 256 is great enough to overcome the combined force of the K5 spring and the head pressure applied at the head pilot port 254, the fourth directional control valve 252 opens. When the fourth directional control valve 252 opens, pilot fluid flows from the pilot fluid source 276, through pilot fluid conduit 262, through fourth directional control valve 252, and through pilot fluid conduit 266 to the pilot port 258 of first directional control valve 218. The fourth directional control valve 252 biasing spring may be chosen such that the K5 spring preload force corresponds to the second predetermined value, and the fourth directional control valve 252 opens when the rod pressure exceeds the head pressure by the second predetermined value.

In one embodiment, as shown in FIG. 4, the input port of the fourth directional control valve 252 may be connected to the rod retraction pilot port 240 of the metering control valve 204, such that the input port is fluidly connected to the pilot fluid source 276 when the rod retraction pilot port 240 is connected to the pilot fluid source 276. In this embodiment, the pilot fluid source 276 may be fluidly connected to pilot port 258 of the first directional valve 218 when the metering control valve 204 is in the rod retraction position and the rod pressure exceeds the head pressure by a second predetermined value.

Figure 5:
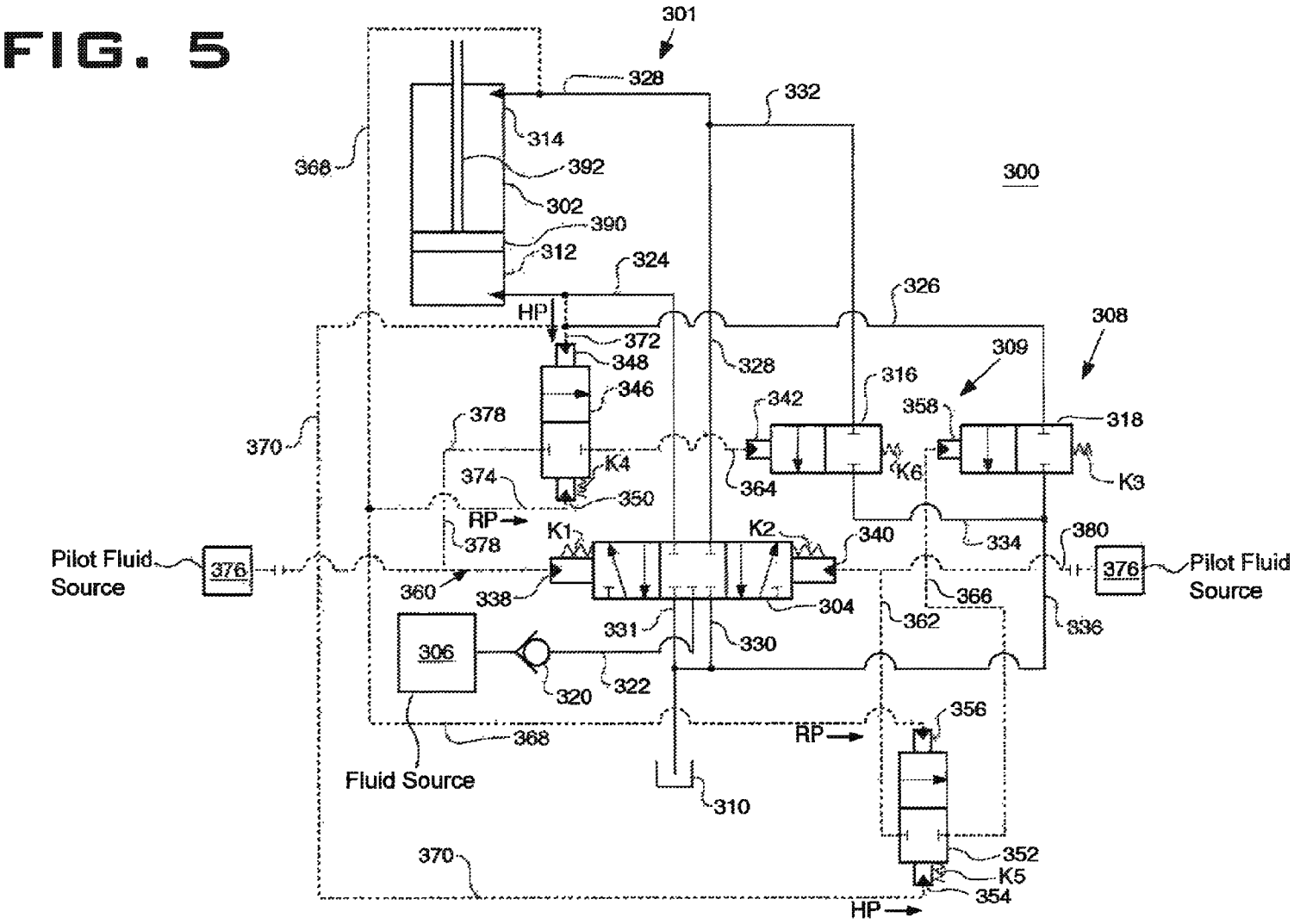
FIG. 5 illustrates an exemplary second embodiment of a hydraulic system with a metering control valve in a closed position.
Figure 6:
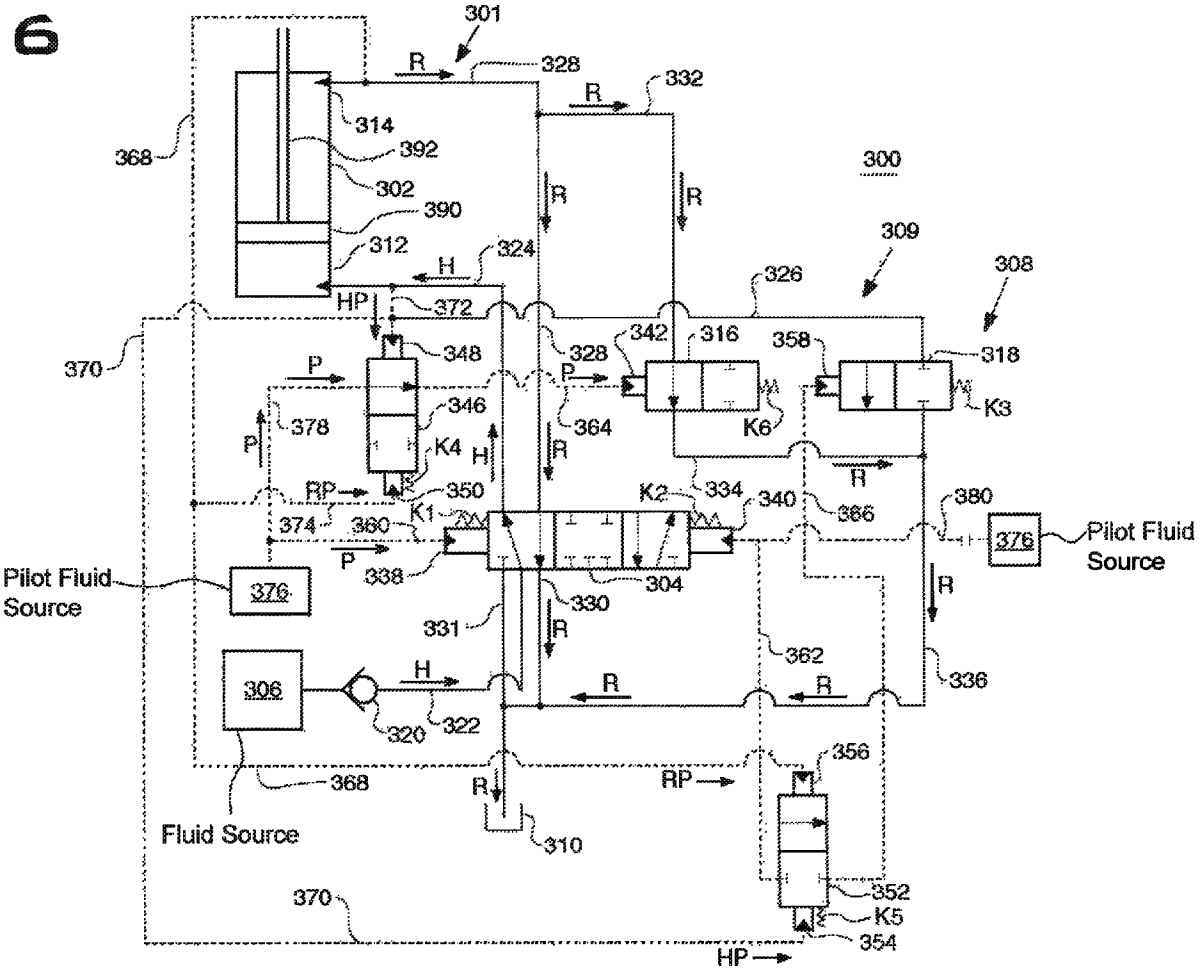
FIG. 6 illustrates the exemplary second embodiment of the hydraulic system with the metering control valve in a rod extension position.
Figure 7:
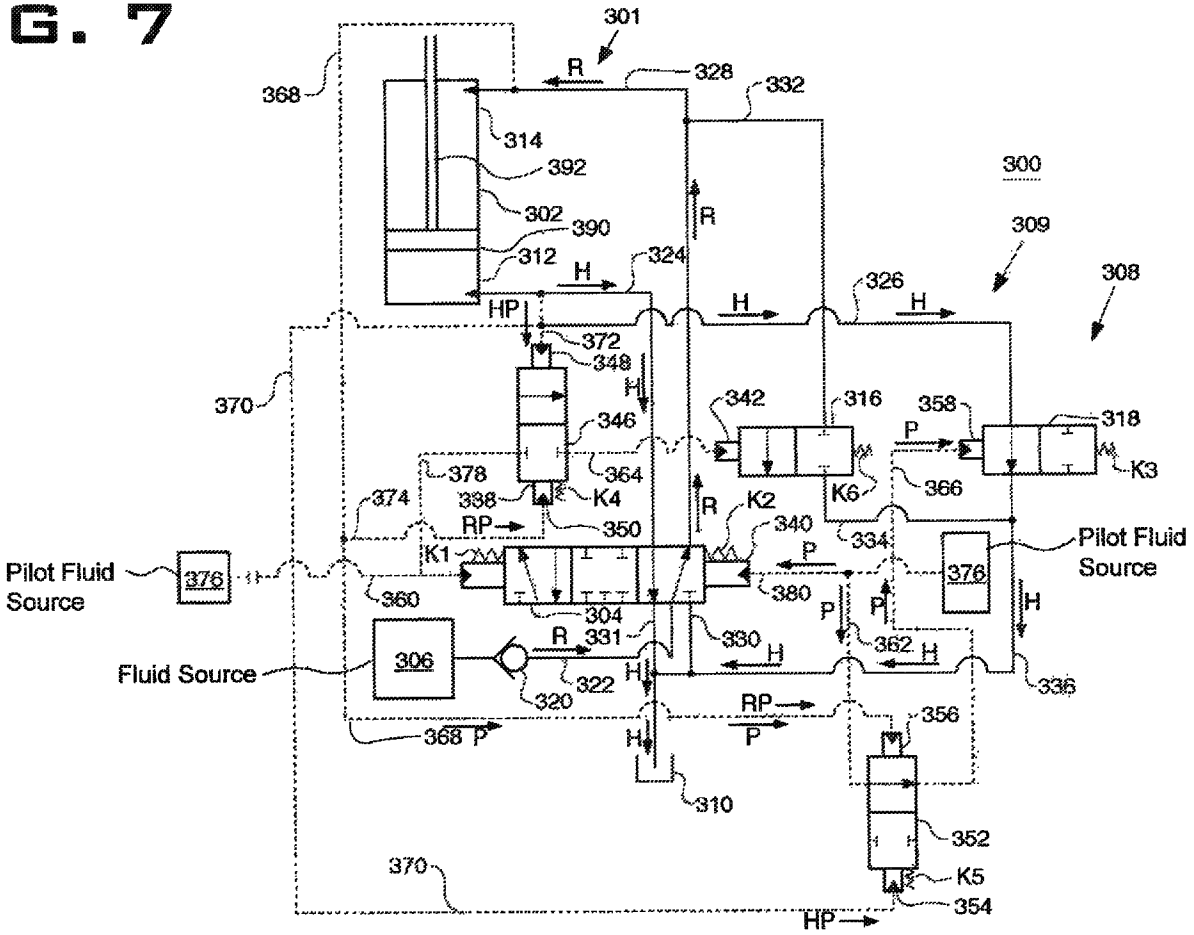
FIG. 7 illustrates the exemplary second embodiment of the hydraulic system with the metering control valve in a rod retraction position.

Referring now to FIGS. 5, 6, and 7, a second embodiment of a hydraulic system 300 is depicted. The system 300 includes a first hydraulic circuit 301, and a second hydraulic circuit 308. The first hydraulic circuit 301 is similar to the first hydraulic circuit 201 in the first embodiment, as depicted in FIGS. 2-4. Similar components are numbered similarly (except that they are designated with a 300 series element number as opposed to a 200 series element number) and are similar in function and structure as those described in relation to FIGS. 2-5. FIG. 5 depicts system 300 with metering control valve 304 in the closed position. FIG. 6 depicts system 300 with metering control valve 304 in the rod extension position and illustrates fluid flow when the head pressure exceeds the rod pressure by a first predetermined value. FIG. 7 depicts system 300 with metering control valve 304 in the rod retraction position and illustrates fluid flow when the rod pressure exceeds the head pressure by a second predetermined value.

Similarly to hydraulic system 200, hydraulic system 300 is suitable for use in the excavator 106 of FIG. 1. The hydraulic cylinder assembly 302 may, for example, correspond to the work implement cylinder assembly 102. The hydraulic system 300 may also be suitable for use actuating other linkages illustrated in FIG. 1, or for actuating other tools on other machines 100.

The second hydraulic circuit 308 includes a second circuit valve assembly 309 selectively fluidly connected to the head end 312, the rod end 314, and the fluid tank 310. The second circuit valve assembly 309 is operable to fluidly connect the rod end 314 to the fluid tank when the head pressure exceeds the rod pressure by a first predetermined value. The second circuit valve assembly 309 is also operable to fluidly connect the head end 312 to the fluid tank 310 when the rod pressure exceeds the head pressure by a second predetermined value.

In the embodiment as shown in relation to FIGS. 5-7, the second circuit valve assembly 309 includes a first directional control valve 318, a second directional control valve 316, a third directional control valve 346, and a fourth directional control valve 352.

The first directional control valve 318 may include a two position, spring biased, normally closed, and hydraulically actuated directional valve. Although the first directional control valve 318 is shown as a hydraulically actuated valve, it is contemplated that the first directional control valve 318 may be actuated by other means, such as, but not limited to, electrical current or pneumatics. In alternative embodiments the first directional control valve 318 may include any device for controlling the flow of fluid in the second hydraulic circuit from the head end 312 to the tank 310.

The first directional control valve 318 may include a pilot port 358, and a biasing spring with a spring constant of K3. As illustrated in FIG. 7, when fluid with a pressure great enough to overcome the K3 spring constant is applied to the pilot port 358, first directional control valve 318 opens, allowing fluid to flow from the head end 312, through fluid conduit 326, through the first directional control valve 318, through fluid conduit 336, and to the tank 310. The pilot port 358 may be selectively fluidly connected to pilot fluid source 376. As illustrated in FIG. 7, when the head pressure exceeds the rod pressure by a first predetermined value, pilot fluid may flow from the pilot fluid source 376 to pilot port 358.

The first directional control valve 318 may include an input port and an output port. The input port of the first directional control valve 318 may be fluidly connected to the head end 312 through fluid conduit 326. The output port of the first directional control valve 318 may be fluidly connected to the tank 310 through fluid conduit 336.

The second directional control valve 316 may include a two position, spring biased, normally closed, and hydraulically actuated directional valve. Although the second directional control valve 316 is shown as a hydraulically actuated valve, it is contemplated that the second directional control valve 316 may be actuated by other means, such as, but not limited to, electrical current or pneumatics. In alternative embodiments the second directional control valve 316 may include any device for controlling the flow of fluid in the second hydraulic circuit from the rod end 314 to the tank 310.

The second directional control valve 316 may include a pilot port 342, and a biasing spring with a spring constant of K6. As illustrated in FIG. 6, when fluid with a pressure great enough to overcome the K6 spring constant is applied to the pilot port 342, second directional control valve 316 opens, allowing fluid to flow from the rod end 314, through fluid conduit 332, through the second directional control valve 316, through fluid conduit 334, and to the tank 310. The pilot port 342 may be selectively fluidly connected to pilot fluid source 376. As illustrated in FIG. 6, when the head pressure exceeds the rod pressure by a first predetermined value, pilot fluid may flow from pilot fluid source 376 to pilot port 342.

The second directional control valve 316 may include an input port and an output port. The input port of the second directional control valve 316 may be fluidly connected to the rod end 312 through fluid conduit 332. The output port of the second directional control valve 316 may be fluidly connected to the tank 310 through fluid conduit 334.

The third directional control valve 346 may include a two position, spring biased, normally closed, and hydraulically actuated directional valve. Although the third directional control valve 346 is shown as a hydraulically actuated valve, it is contemplated that the third directional control valve 346 may be actuated by other means, such as, but not limited to, electrical current or pneumatics. In alternative embodiments the third directional control valve 346 may include any device for fluidly connecting the pilot fluid source 376 to the pilot port 342 of the second directional valve 316 when the head pressure exceeds the rod pressure by the first predetermined value.

The third directional control valve 346 may include an input port and an output port. The input port may be fluidly connected to the pilot fluid source 376 through pilot fluid conduit 378. In one embodiment, the input port may be connected to the rod extension pilot port 338 of the metering control valve 304, such that the input port is fluidly connected to the pilot fluid source 376 when the rod extension pilot port 338 is connected to the pilot fluid source 376. The output port of third directional control valve 346 may be fluidly connected to the pilot port 342 of the second directional control valve 316 through pilot fluid conduit 364.

The third directional control valve 346 may include a head pilot port 348, and a rod pilot port 350. The head pilot port 348 may be fluidly connected to the head end 312, through pilot fluid conduit 372, such that the head pressure is applied to head pilot port 348 as indicated by "HP" and an arrow. The rod pilot port 350 may be fluidly connected to the rod end 314, through pilot fluid conduit 374, such that the rod pressure is applied to rod pilot port 350 as indicated by "RP" and an arrow.

The third directional control valve 346 may include a biasing spring, with a spring constant of K4. As illustrated in FIG. 6, when the head pressure applied at the head pilot port 348 is great enough to overcome the combined force of the K4 spring and the rod pressure applied at the rod pilot port 350, the third directional control valve 346 opens. When the third directional valve 346 opens, pilot fluid flows from the pilot fluid source 376, through pilot fluid conduit 378, through third directional control valve 346, through pilot fluid conduit 364, and to the pilot port 342 of second directional control valve 316. The third directional control valve 346 biasing spring may be chosen such that the K4 spring constant corresponds to the first predetermined value, and the third directional control valve 346 opens when the head pressure exceeds the rod pressure by the first predetermined value.

In the embodiment where the input port of the third directional control valve 346 is connected to the rod extension pilot port 338 of the metering control valve 304, the pilot fluid source 376 may be fluidly connected to pilot port 342 of the second directional valve 316 when the metering control valve 304 is in the rod extension position and the head pressure exceeds the rod pressure by the first predetermined value, as illustrated in FIG. 6.

The fourth directional control valve 352 may include a two position, spring biased, normally closed, and hydraulically actuated directional valve. Although the fourth directional control valve 352 is shown as a hydraulically actuated valve, it is contemplated that the fourth directional control valve 352 may be actuated by other means, such as, but not limited to, electrical current or pneumatics. In alternative embodiments the fourth directional control valve 352 may include any device for fluidly connecting the pilot fluid source 376 to the pilot port 358 of the first directional valve 318 when the rod pressure exceeds the head pressure by the second predetermined value.

The fourth directional control valve 352 may include an input port and an output port. The input port may be fluidly connected to the pilot fluid source 376 through pilot fluid conduit 362. The output port of fourth directional control valve 352 may be fluidly connected to the pilot port 358 of the first directional control valve 318 through pilot fluid conduit 366.

The fourth directional control valve 352 may include a rod pilot port 356, and a head pilot port 354. The rod pilot port 356 may be fluidly connected to the rod end 314, through pilot fluid conduit 368, such that the rod pressure is applied to rod pilot port 356 as indicated by "RP" and an arrow. The head pilot port 354 may be fluidly connected to the head end 312, through pilot fluid conduit 370, such that the head pressure is applied to head pilot port 354 as indicated by "HP" and an arrow.

The fourth directional control valve 352 may include a biasing spring, with a spring constant of K5. As illustrated in FIG. 7, when the rod pressure applied at the rod pilot port 356 is great enough to overcome the combined force of the K5 spring and the head pressure applied at the head pilot port 354, the fourth directional control valve 352 opens. When the fourth directional control valve 352 opens, pilot fluid flows from the pilot fluid source 376, through pilot fluid conduit 362, through fourth directional control valve 352, through pilot fluid conduit 366, and to the pilot port 358 of first directional control valve 318. The fourth directional control valve 352 biasing spring may be chosen such that the K5 spring constant corresponds to the second predetermined value and the fourth directional control valve 352 opens when the rod pressure exceeds the head pressure by the second predetermined value.

In the embodiment where the input port of the fourth directional control valve 352 is connected to the rod retraction pilot port 340 of the metering control valve 304, the pilot fluid source 376 may be fluidly connected to the pilot port 358 of first directional valve 318 when the metering control valve 304 is in the rod retraction position and the rod pressure exceeds the head pressure by the second predetermined value, as illustrated in FIG. 7.

INDUSTRIAL APPLICABILITY

Machines with work implement control systems actuated with hydraulic circuits and hydraulic cylinder assemblies may size hydraulic fluid conduits to allow operators more control when work implements are subject to over-running loads. Smaller cross sectional sizing of fluid conduits may also allow fine control of work implement movements during operation. Although smaller cross sectional fluid conduits may allow better control during certain work conditions, they may be less power efficient and slower to respond in comparison to larger cross sectional fluid conduits, when work implements encounter resistive loads.

In the excavator 106 of FIG. 1, an operator may command a dig function through the operator interface 188. For example, the operator may move the joystick 120 to actuate the boom 122, stick 124, and bucket 126 to dig material on the worksite 110. In another embodiment, a remote or automated system may command a dig function. The controller 182 may receive the dig function commands and transmit signals to actuate the boom cylinder assembly 128, the stick cylinder assembly 130, and the work implement cylinder assembly 102.

Referring to FIGS. 1-4, the controller 182 may transmit signals to fluidly connect the pilot fluid source 276 to the rod extension pilot port 238 of the metering control valve 204 through fluid conduit 260. The pressure of the pilot fluid at rod extension pilot port 238 may overcome the force of the K2 spring and the metering control valve 204 may move to the rod extension position as shown in FIG. 3.

Further as shown in FIG. 3, pressurized fluid may flow from the fluid source 206, through check valve 220, through fluid conduit 222, through the metering control valve 204, through fluid conduit 224, and into the head end 212. The arrows marked "H" illustrate the flow of pressurized fluid to the head end 212.

The pressurized fluid flowing into the head end 212 may push the piston of rod 292 and begin extending the rod 292 from the cylinder 290. As the rod 292 begins extending, fluid may flow out of the rod end 214, through fluid conduit 228, through the metering control valve 204, through fluid conduit 230, and to the tank 210. Fluid may also flow from the rod end 214, through fluid conduit 232, through the inverse shuttle valve 216 (if the head pressure exceeds the rod pressure), through fluid conduit 234, and to the input port of first directional control valve 218. Until the head pressure exceeds the rod pressure by the first predetermined value, the first directional control valve 218 will remain closed, and fluid from conduit 234 will not flow to the tank 210. As long as the first directional control valve remains closed, all flow from the rod end 214 to the tank 210 will flow through fluid conduit 228, control valve 204, and fluid conduit 230.

As the rod 292 extends, the work implement linkage assembly 134 may curl the bucket 126 towards the stick 124 and the cab 118. When the bucket 126 hits the ground of the worksite 110, the material the bucket 126 is digging into may exert a force against the rod 292 extending. This force may cause the head pressure to rise above the rod pressure. When the head pressure exceeds the rod pressure by the first predetermined value, the head pressure force on the head pilot port 248 of third directional control 246 exceeds the combined force of the K4 spring and the rod pressure force at rod pilot port 250, and the third directional control valve 246 opens.

When third directional control valve 246 opens, pilot fluid from the pilot fluid source 276 may flow through pilot fluid conduit 278, through the third directional control valve 246, through pilot fluid conduit 264, to the pilot port 258 of the first directional control valve 218. In FIG. 3, the arrows marked "P" illustrate the flow of fluid from the pilot fluid source 276 to the pilot port 258, through third directional control valve 246.

When the first directional control valve 218 opens, in addition to fluid flowing through fluid conduit 228, control valve 204, and fluid conduit 230, fluid may flow out of the rod end 214 of cylinder assembly 292, through fluid conduit 232 to rod port 242 of inverse shuttle valve 216. Since the head end pressure exceeds the rod end pressure, the fluid may flow through the inverse shuttle valve 216 from rod port 242, exiting through the output port, through fluid conduit 234, through the first directional control valve 218 and through fluid conduit 236 to the tank 210. In FIG. 3, the arrows marked "R" illustrate the flow of fluid from the rod end 214 to the tank 210.

The additional flow path for fluid from the rod end 214 to the tank 210 may reduce restriction to the fluid flow, increase efficiency and productivity of the machine 100.

In another example in the excavator 106 of FIG. 1, an operator may command a dump function through the operator interface 188. For example, the operator may move the joystick 120 to actuate the boom 122, stick 124, and bucket 126 to dump material in the bucket 126 into a truck (not shown) or other holding vehicle. In another embodiment, a remote or automated system may command a dump function.

As the operator (or other source) commands the dump function, that the rod 132 (292) may retract, causing the bucket 126 to curl out away from the cab 118, such that the material in the bucket 126 can be dumped in the truck or other holding vehicle.

The controller 182 may transmit signals to fluidly connect the pilot fluid source 276 to the rod refraction pilot port 240 of the metering control valve 204 through fluid conduit 280. The pressure of the pilot fluid at rod retraction pilot port 240 may overcome the force of the K1 spring and the metering control valve 204 may move to the rod refraction position as shown in FIG. 4.

As further shown in FIG. 4, pressurized fluid may flow from the fluid source 206, through check valve 220, through fluid conduit 222, through the metering control valve 204, through fluid conduit 228, and into the rod end 214. The arrows marked "R" illustrate the flow of pressurized fluid to the rod end 214.

The pressurized fluid flowing into the rod end 214 may push the piston of rod 292 and begin retracting the rod 292 into the cylinder 290. As the rod 292 begins retracting, fluid may flow out of the head end 212, through fluid conduit 224, through the metering control valve 204, through fluid conduit 231, and to the tank 210. Fluid may also flow from the head end 212, through fluid conduit 226, and through the inverse shuttle valve 216 (if the rod pressure exceeds the head pressure), through fluid conduit 234, and to the input port of first directional control valve 218. Until the rod pressure exceeds the head pressure by the second predetermined value, the first directional control valve 218 will remain closed, and fluid from conduit 234 will not flow to the tank 210. As long as the first directional control valve 218 remains closed, all flow from the head end 212 to the tank 210 will flow through fluid conduit 224, control valve 204, and fluid conduit 231.

As the rod 292 retracts, the work implement linkage assembly 134 may curl the bucket 126 away from the cab 118. There may be some portions of the dump function of the work cycle where the material in the bucket 126 exerts a force opposing the refraction of the rod 292 into the cylinder 290. This force may cause the rod pressure to rise further above the head pressure. When the rod pressure exceeds the head pressure by the second predetermined value, the rod pressure force on the rod pilot port 256 of fourth directional control valve 252 may exceed the combined force of the K5 spring and the head pressure force at head pilot port 254, and the fourth directional control valve 252 may open.

When fourth directional control valve 252 opens, pilot fluid from the pilot fluid source 276 may flow through pilot fluid conduit 262, through the fourth directional control valve 252, through pilot fluid conduit 266, to the pilot port 258 of the first directional control valve 218. In FIG. 4, the arrows marked "P" illustrate the flow of pilot fluid from the pilot fluid source 276 to the pilot port 258 through fourth directional control valve 252.

When the first directional control valve 218 opens, in addition to fluid flowing through fluid conduit 224, control valve 204, and fluid conduit 231, fluid may flow out of the head end 212 of cylinder assembly 202, through fluid conduit 226 to head port 244 of inverse shuttle valve 216. Since the rod end pressure exceeds the head end pressure, the fluid may flow through the inverse shuttle valve 216 from port 244, exiting through the output port, through fluid conduit 234, through the first directional control valve 218 and through fluid conduit 236 to the tank 210. In FIG. 4, the arrows marked "H" illustrate the flow of fluid from the head end 214 to the tank 210.

The additional flow path for fluid from the head end 212 to the tank 210 may reduce restriction to the fluid flow, increase efficiency and productivity of the machine 100.

Referring now to FIGS. 1, and 5-7, in another example of the excavator 106 of FIG. 1, an operator may command a dig function through the operator interface 188. For example, the operator may move the joystick 120 to actuate the boom 122, stick 124, and bucket 126 to dig material on the worksite 110. In another embodiment, a remote or automated system may command a dig function.

The controller 182 may receive the dig function commands and transmit signals to actuate the boom cylinder assembly 128, the stick cylinder assembly 130, and the work implement cylinder assembly 102. The controller 182 may transmit signals to fluidly connect the pilot fluid source 376 to the rod extension pilot port 338 of the metering control valve 304 through fluid conduit 360. The pressure of the pilot fluid at rod extension pilot port 338 may overcome the K2 spring force and the metering control valve 304 may move to the rod extension position as shown in FIG. 6.

As further shown in FIG. 6, pressurized fluid may flow from the fluid source 306, through check valve 320, through fluid conduit 322, through the metering control valve 304, through fluid conduit 324, and into the head end 312. The arrows marked "H" illustrate the flow of pressurized fluid to the head end 312.

The pressurized fluid flowing into the head end 312 may push the piston of rod 392 and begin extending the rod 392 from the cylinder 390. As the rod 392 begins extending, fluid may flow out of the rod end 314, through fluid conduit 328, through the metering control valve 304, through fluid conduit 330, and to the tank 310. Fluid may also flow from the rod end 314, through fluid conduit 332 to the input port of second directional control valve 316. Until the head pressure exceeds the rod pressure by a first predetermined value, the second directional control valve 316 will remain closed, and fluid from conduit 332 will not flow to the tank 310. As long as the second directional control valve 316 remains closed, all flow from the rod end 314 to the tank 310 will flow through fluid conduit 328, control valve 304, and fluid conduit 330.

As the rod 392 extends, the work implement linkage assembly 134 may curl the bucket 126 towards the stick 124 and the cab 118. When the bucket 126 hits the ground of the worksite 110, the material the bucket 126 is digging into may exert a force against the rod 392 extending. This force may cause the head pressure to rise further above the rod pressure. When the head pressure exceeds the rod pressure by a first predetermined value, the head pressure force on the head pilot port 348 of third directional control 346 may exceed the combined force of the K4 spring and the rod pressure force at rod pilot port 350, and the third directional control valve 346 may open.

When third directional control valve 346 opens, pilot fluid from the pilot fluid source 376 may flow through pilot fluid conduit 378, through the third directional control valve 346, through pilot fluid conduit 364, to the pilot port 342 of the second directional control valve 316. In FIG. 6, the arrows marked "P" illustrate the flow of fluid from the pilot fluid source 376 to the pilot port 342, through third directional control valve 346.

When the second directional control valve 316 opens, in addition to fluid flowing through fluid conduit 328, control valve 204, and fluid conduit 330, fluid may flow out of the rod end 314 of cylinder assembly 302, through fluid conduit 332, through the second directional control valve 316, and through fluid conduits 334 and 336 to the tank 310. In FIG. 6, the arrows marked "R" illustrate the flow of fluid from the rod end 314 to the tank 310.

The additional flow path for fluid from the rod end 314 to the tank 310 may reduce restriction to fluid flow, increase efficiency and productivity of the machine 100.

In another example of the excavator 106 of FIG. 1, an operator may command a dump function through the operator interface 188. For example, the operator may move the joystick 120 to actuate the boom 122, stick 124, and bucket 126 to dump material in the bucket 126 into a truck (not shown) or other holding vehicle. In another embodiment, a remote or automated system may command the dump function.

As the operator (or other source) commands the dump function, he/she/it may command that the bucket 126 curl out away from the cab 118 by commanding that the rod 132 (392) retract, while lifting the bucket 126, such that the material in the bucket 126 can be dumped into the truck or other holding vehicle.

The controller 182 may transmit signals to fluidly connect the pilot fluid source 376 to the rod refraction pilot port 340 of the metering control valve 304 through fluid conduit 380. The pressure of the pilot fluid at rod retraction pilot port 340 may overcome the force of the K1 spring and the metering control valve 304 may move to the rod retraction position as shown in FIG. 7.

As further shown in FIG. 7, pressurized fluid may flow from the fluid source 306, through check valve 320, through fluid conduit 322, through the metering control valve 304, through fluid conduit 328, and into the rod end 314. The arrows marked "R" illustrate the flow of pressurized fluid to the rod end 314.

The pressurized fluid flowing into the rod end 314 may push the piston of rod 392 and begin retracting the rod 392 into the cylinder 390. As the rod 392 begins retracting, fluid may flow out of the head end 312, through fluid conduit 324, through the metering control valve 304, through fluid conduit 331, and to the tank 310. Fluid may also flow from the head end 312, through fluid conduit 326 to the input port of first directional control valve 318. Until the rod pressure exceeds the head pressure by the second predetermined value, the first directional control valve 318 will remain closed, and fluid from conduit 326 will not flow to the tank 310. As long as the first directional control valve 318 remains closed, all flow from the head end 312 to the tank 310 will flow through fluid conduit 324, control valve 304, and fluid conduit 331.

As the rod 392 retracts, the work implement linkage assembly 134 may curl the bucket 126 away from the cab 118. There may be some portions of the dump function of the work cycle where the material in the bucket 126 exerts a force opposing the refraction of the rod 392 into the cylinder 390. This force may cause the rod pressure to rise further above the head pressure. When the rod pressure exceeds the head pressure by the second predetermined value, the rod pressure force on the rod pilot port 356 of fourth directional control valve 352 may exceed the combined force of the K5 spring and the head pressure force at head pilot port 354, and the fourth directional control valve 352 may open.

When fourth directional control valve 352 opens, pilot fluid from the pilot fluid source 376 may flow through pilot fluid conduit 362, through the fourth directional control valve 352, through pilot fluid conduit 366, to the pilot port 358 of the first directional control valve 318. In FIG. 7, the arrows marked "P" illustrate the flow of fluid from the pilot fluid source 376 to the pilot port 358 through fourth directional control valve 352.

When the first directional control valve 318 opens, in addition to fluid flowing to the tank 310 through fluid conduit 324, control valve 304, and fluid conduit 331, fluid may flow to the tank 310 out of the head end 312 of cylinder assembly 302, through fluid conduit 326, through the first directional control valve 318, and through fluid conduit 336. In FIG. 7, the arrows marked "H" illustrate the flow of fluid from the head end 312 to the tank 310.

The additional flow path for fluid from the head end 312 to the tank 310 may reduce restriction to the fluid flow, increase efficiency and productivity of the machine 100.

From the foregoing, it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A hydraulic system, comprising:

a first hydraulic circuit including:

a hydraulic cylinder assembly including a cylinder, a rod, a head end including a head pressure, and a rod end including a rod pressure, a pressurized fluid source, a fluid tank, a metering control valve including a rod extension position, and a rod retraction position, the control valve fluidly connected to the head end, the rod end, the pressurized fluid source, and the fluid tank, and a second hydraulic circuit including a second circuit valve assembly selectively fluidly connected to the head end, the rod end, and the fluid tank, and wherein:

the second circuit valve assembly is operable to fluidly connect the rod end to the fluid tank when the head pressure exceeds the rod pressure by a first predetermined value, the second circuit valve assembly is operable to fluidly connect the head end to the fluid tank when the rod pressure exceeds the head pressure by a second predetermined value, and the second circuit valve assembly includes:

(i) an inverse shuttle valve including:

a rod end input port fluidly connected to the rod end, a head end input port fluidly connected to the head end, and an output port selectively fluidly connected to the fluid tank; and (ii) a spring biased, and normally closed first directional control valve including:

a pilot port selectively fluidly connected to a pilot fluid source when the head pressure exceeds the rod pressure by a first predetermined value, or the rod pressure exceeds the head pressure by a second predetermined value, an input pot fluidly connected to the inverse shuttle valve output port, and an output port fluidly connected to the fluid tank.

2. The hydraulic system of claim 1, wherein the metering control valve includes a rod extension port selectively fluidly connected to the pilot fluid source, and a rod retraction port selectively fluidly connected to the pilot fluid source.

3. The hydraulic system of claim 2, wherein the metering control valve moves into the rod extension position when the rod extension port is connected to the pilot fluid source, connecting the pressurized fluid source to the head end of the hydraulic cylinder assembly.

4. The hydraulic system of claim 2, wherein the metering control valve moves into the rod retraction position when the rod retraction port is connected to the pilot fluid source, connecting the pressurized fluid source to the rod end of the hydraulic cylinder assembly.

5. The hydraulic system of claim 1, wherein the second hydraulic circuit valve assembly further includes a spring biased, and normally closed third directional control valve including:

a head pilot port fluidly connected to the head end, a rod pilot port fluidly connected to the rod end, an input port fluidly connected to the pilot fluid source when the metering control valve is in the rod extension position, and an output port fluidly connected to the pilot port of the first directional control valve.

6. The hydraulic system of claim 5 wherein the third directional control valve includes a spring with a spring constant such that the spring contracts and the third directional control valve opens when the head pressure exceeds the rod pressure by the first predetermined value.

7. The hydraulic system of claim 5, wherein:

the metering control valve includes a rod extension port selectively fluidly connected to the pilot fluid source, and the input port of the third directional control valve is fluidly connected to the rod extension pilot port of the metering control valve.

8. The hydraulic circuit of claim 1, wherein the second hydraulic circuit valve assembly further includes a spring biased, and normally closed fourth directional control valve including:

a first pilot port fluidly connected to the rod end, a second pilot port fluidly connected to the head end, an input port fluidly connected to the pilot fluid source when the metering control valve is in the rod retraction position, and an output port fluidly connected to the pilot port of the first directional control valve.

9. The hydraulic system of claim 8, wherein the fourth directional control valve includes a spring with a spring constant such that the spring contracts and the fourth directional control valve opens when the rod pressure exceeds the head pressure by the second predetermined value.

10. The hydraulic system of claim 8, wherein;

the metering control valve includes a rod retraction port selectively fluidly connected to the pilot fluid source, and the input port of the fourth directional control valve is fluidly connected to the rod retraction pilot port of the metering control valve.

11. The hydraulic system of claim 1, wherein the input port of the spring biased, and normally closed first directional control valve is fluidly connected to the head end.

12. The hydraulic system of claim 11, wherein the second hydraulic circuit valve assembly further includes a spring biased, and normally closed third directional control valve including:

a head pilot port fluidly connected to the head end, a rod pilot port fluidly connected to the rod end, an input port fluidly connected to the pilot fluid source when the metering control valve is in the rod extension position, and an output port fluidly connected to the pilot port of the first directional control valve.

13. The hydraulic system of claim 12 wherein the third directional control valve includes a spring with a spring constant such that the spring contracts and the third directional control valve opens when the head pressure exceeds the rod pressure by the first predetermined value.

14. The hydraulic system of claim 13, wherein;

the metering control valve includes a rod extension port selectively fluidly connected to the pilot fluid source, and the input port of the third directional control valve is fluidly connected to the rod extension pilot port of the metering control valve.

15. The hydraulic system of claim 14, wherein the second hydraulic circuit valve assembly includes a spring biased, and normally closed second directional control valve including:

a pilot port selectively fluidly connected to the pilot fluid source, an input port fluidly connected to the rod end, and an output port fluidly connected to the fluid tank.

16. The hydraulic circuit of claim 15, wherein the second hydraulic circuit valve assembly further includes a spring biased, and normally closed fourth directional control valve including:

a first pilot port fluidly connected to the rod end, a second pilot port fluidly connected to the head end, an input port fluidly connected to the pilot fluid source when the metering control valve is in the rod retraction position, and an output port fluidly connected to the pilot port of the first directional control valve.

17. The hydraulic system of claim 16, wherein;

the fourth directional control valve includes a spring with a spring constant such that the spring contracts and the fourth directional control valve opens when the rod pressure exceeds the head pressure by the second predetermined value, the metering control valve includes a rod extension port selectively fluidly connected to the pilot fluid source, and the fourth directional control valve input port is fluidly connected to the rod retraction pilot port of the metering control valve.

18. A machine comprising:

a power source;

a work implement;

a hydraulic system including:

a first hydraulic circuit including:

a hydraulic cylinder assembly including a head end including a head pressure, and a rod end including a rod pressure, a cylinder, and a rod operably connected to the work implement, a pressurized fluid source powered by the power source, a fluid tank, a metering control valve including, a rod extension position, and a rod retraction position, the control valve fluidly connected to the head end, the rod end, the pressurized fluid source, and the fluid tank, and a second hydraulic circuit including a second circuit valve assembly selectively fluidly connected to the head end, the rod end, and the fluid tank, and wherein:

the second circuit valve assembly is operable to fluidly connect the rod end to the fluid tank when the head pressure exceeds the rod pressure by a first predetermined value, and the second circuit valve assembly is operable to fluidly connect the head end to the fluid tank when the rod pressure exceeds the head pressure by a second predetermined value, the second circuit valve assembly includes:

(i) an inverse shuttle valve including:

a rod end input port fluidly connected to the rod end, a head end input port fluidly connected to the head end, and an output port selectively fluidly connected to the fluid tank; and (ii) a spring biased, and normally closed first directional control valve including:

a pilot port selectively fluidly connected to a pilot fluid source when the head pressure exceeds the rod pressure by a first predetermined value, or the rod pressure exceeds the head pressure by a second predetermined value, an input port fluidly connected to the inverse shuttle valve output port, and an output port fluidly connected to the fluid tank.

19. A hydraulic system, comprising:

a first hydraulic circuit including:

a hydraulic cylinder assembly including a cylinder, a rod, a head end including a head pressure, and a rod end including a rod pressure, a pressurized fluid source, a fluid tank, a metering control valve including a rod extension position, and a rod retraction position, the control valve fluidly connected to the head end, the rod end, the pressurized fluid source, and the fluid tank, and a second hydraulic circuit including a second circuit valve assembly selectively fluidly connected to the head end, the rod end, and the fluid tank, and wherein:

the second circuit valve assembly is operable to fluidly connect the rod end to the fluid tank when the head pressure exceeds the rod pressure by a first predetermined value, the second circuit valve assembly is operable to fluidly connect the head end to the fluid tank when the rod pressure exceeds the head pressure by a second predetermined value, and the second circuit valve assembly includes:

(i) a spring biased, and normally closed first directional control valve including:

a pilot port selectively fluidly connected to a pilot fluid source, an input port is fluidly connected to the head end, and an output port fluidly connected to the fluid tank; and (ii) a spring biased, and normally closed third directional control valve including:

a head pilot port fluidly connected to the head end, a rod pilot port fluidly connected to the rod end, an input port fluidly connected to the pilot fluid source when the metering control valve is in the rod extension position, and an output port fluidly connected to the pilot port of the first directional control valve.

* * * * *